US009239559B2

(12) United States Patent
Uchitani et al.

(10) Patent No.: US 9,239,559 B2
(45) Date of Patent: Jan. 19, 2016

(54) FIXING DEVICE AND IMAGE FORMING APPARATUS INCLUDING SAME

(71) Applicants: Takeshi Uchitani, Kanagawa (JP); Masahiko Satoh, Tokyo (JP); Kenji Ishii, Kanagawa (JP); Tadashi Ogawa, Tokyo (JP); Teppei Kawata, Kanagawa (JP); Arinobu Yoshiura, Kanagawa (JP); Toshihiko Shimokawa, Kanagawa (JP); Kensuke Yamaji, Kanagawa (JP); Takamasa Hase, Shizuoka (JP); Shuutaroh Yuasa, Kanagawa (JP); Masaaki Yoshikawa, Tokyo (JP); Hiromasa Takagi, Tokyo (JP); Takahiro Imada, Kanagawa (JP); Hajime Gotoh, Kanagawa (JP); Akira Suzuki, Tokyo (JP); Takuya Seshita, Kanagawa (JP); Hiroshi Yoshinaga, Chiba (JP); Kazuya Saito, Kanagawa (JP); Shinichi Namekata, Kanagawa (JP); Takayuki Seki, Kanagawa (JP); Yuji Arai, Kanagawa (JP); Ryuuichi Mimbu, Kanagawa (JP); Yoshiki Yamaguchi, Kanagawa (JP); Shuntaroh Tamaki, Kanagawa (JP); Yutaka Ikebuchi, Kanagawa (JP)

(72) Inventors: Takeshi Uchitani, Kanagawa (JP); Masahiko Satoh, Tokyo (JP); Kenji Ishii, Kanagawa (JP); Tadashi Ogawa, Tokyo (JP); Teppei Kawata, Kanagawa (JP); Arinobu Yoshiura, Kanagawa (JP); Toshihiko Shimokawa, Kanagawa (JP); Kensuke Yamaji, Kanagawa (JP); Takamasa Hase, Shizuoka (JP); Shuutaroh Yuasa, Kanagawa (JP); Masaaki Yoshikawa, Tokyo (JP); Hiromasa Takagi, Tokyo (JP); Takahiro Imada, Kanagawa (JP); Hajime Gotoh, Kanagawa (JP); Akira Suzuki, Tokyo (JP); Takuya Seshita, Kanagawa (JP); Hiroshi Yoshinaga, Chiba (JP); Kazuya Saito, Kanagawa (JP); Shinichi Namekata, Kanagawa (JP); Takayuki Seki, Kanagawa (JP); Yuji Arai, Kanagawa (JP); Ryuuichi Mimbu, Kanagawa (JP); Yoshiki Yamaguchi, Kanagawa (JP); Shuntaroh Tamaki, Kanagawa (JP); Yutaka Ikebuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/763,040

(22) Filed: Feb. 8, 2013

(65) Prior Publication Data

US 2013/0209121 A1 Aug. 15, 2013

(30) Foreign Application Priority Data

Feb. 9, 2012 (JP) ..... 2012-026059

(51) Int. Cl.
*G03G 15/20* (2006.01)

(52) U.S. Cl.
CPC ..... *G03G 15/2078* (2013.01); *G03G 15/205* (2013.01); *G03G 15/2039* (2013.01); *G03G 2215/2035* (2013.01)

(58) Field of Classification Search
CPC ..... G03G 15/2078; G03G 15/205; G03G 15/2039; G03G 2215/2035
USPC ..... 399/67, 68, 43
See application file for complete search history.

(56) References Cited

U.S. PATENT DOCUMENTS

2006/0029411 A1 2/2006 Ishii et al.
2007/0212089 A1 9/2007 Seo et al.
2007/0242988 A1 10/2007 Seo et al.
2007/0280754 A1 12/2007 Ogawa et al.
2007/0292175 A1 12/2007 Shinshi 2008/0025772 A1 1/2008 Seo et al.
2008/0025773 A1 1/2008 Ito et al.
2008/0219721 A1 9/2008 Ito et al.
2008/0226326 A1 9/2008 Seo et al.
2008/0232873 A1 9/2008 Ueno et al.
2009/0123201 A1 5/2009 Ehara et al.
2009/0148205 A1 6/2009 Seo et al.
2009/0245865 A1 10/2009 Shinshi et al.
2009/0245897 A1 10/2009 Seo et al.
2009/0297197 A1 12/2009 Hase
2010/0061753 A1 3/2010 Hase
2010/0074667 A1 3/2010 Ehara et al.
2010/0092220 A1 4/2010 Hasegawa et al.
2010/0092221 A1 4/2010 Shinshi et al.
2010/0202809 A1 8/2010 Shinshi et al.
2010/0290822 A1 11/2010 Hasegawa et al.
2010/0303521 A1 12/2010 Ogawa et al.
2011/0026988 A1 2/2011 Yoshikawa et al.
2011/0044706 A1 2/2011 Iwaya et al.
2011/0044734 A1 2/2011 Shimokawa et al.
2011/0052237 A1 3/2011 Yoshikawa et al.
2011/0052245 A1 3/2011 Shinshi et al.
2011/0052277 A1 3/2011 Ueno et al.
2011/0052282 A1 3/2011 Shinshi et al.
2011/0058862 A1 3/2011 Yamaguchi et al.
2011/0058863 A1 3/2011 Shinshi et al.
2011/0058864 A1 3/2011 Fujimoto et al.
2011/0058865 A1 3/2011 Tokuda et al.
2011/0058866 A1 3/2011 Ishii et al.
2011/0064437 A1 3/2011 Yamashina et al.
2011/0064443 A1 3/2011 Iwaya et al.
2011/0064450 A1 3/2011 Ishii et al.
2011/0064490 A1 3/2011 Imada et al.
2011/0064502 A1 3/2011 Hase et al.
2011/0076071 A1 3/2011 Yamaguchi et al.
2011/0085815 A1 4/2011 Kishi et al.
2011/0085832 A1 4/2011 Hasegawa et al.
2011/0091253 A1 4/2011 Seo et al.
2011/0116848 A1 5/2011 Yamaguchi et al.
2011/0129268 A1 6/2011 Ishii et al.
2011/0150518 A1 6/2011 Hase et al.
2011/0170917 A1 7/2011 Yoshikawa et al.
2011/0176821 A1 7/2011 Hase
2011/0176822 A1 7/2011 Ishii et al.
2011/0182634 A1 7/2011 Ishigaya et al.
2011/0182638 A1 7/2011 Ishii et al.
2011/0194870 A1 8/2011 Hase et al.
2011/0200368 A1 8/2011 Yamaguchi et al.
2011/0200370 A1 8/2011 Ikebuchi et al.
2011/0206427 A1 8/2011 Iwaya et al.
2011/0211876 A1 9/2011 Iwaya et al.
2011/0217056 A1 9/2011 Yoshinaga et al.
2011/0217057 A1 9/2011 Yoshinaga et al.
2011/0217093 A1 9/2011 Tokuda et al.
2011/0217095 A1 9/2011 Ishii et al.
2011/0222875 A1 9/2011 Imada et al.
2011/0222876 A1 9/2011 Yuasa et al.
2011/0222888 A1 9/2011 Ikebuchi et al.
2011/0222929 A1 9/2011 Fujimoto et al.
2011/0222930 A1 9/2011 Fujimoto et al.
2011/0222931 A1 9/2011 Shinshi et al.
2011/0229162 A1 9/2011 Ogawa et al.
2011/0229178 A1 9/2011 Ogawa et al.
2011/0229181 A1 9/2011 Iwaya et al.
2011/0229200 A1 9/2011 Yamaguchi et al.
2011/0229225 A1 9/2011 Ishii et al.
2011/0229226 A1 9/2011 Tokuda et al.
2011/0229227 A1 9/2011 Yoshikawa et al.
2011/0229228 A1 9/2011 Yoshikawa et al.
2011/0229236 A1 9/2011 Ehara et al.
2011/0274453 A1 11/2011 Shimokawa et al.
2011/0286758 A1 11/2011 Yoshinaga
2011/0293309 A1 12/2011 Hase
2011/0311284 A1 12/2011 Seo et al.
2012/0045226 A1 2/2012 Hase et al.
2012/0051766 A1 3/2012 Ueno et al.
2012/0051774 A1 3/2012 Ikebuchi et al.
2012/0093531 A1 4/2012 Yuasa et al.
2012/0093551 A1 4/2012 Ogawa et al.
2012/0107005 A1 5/2012 Hase et al.
2012/0114345 A1 5/2012 Fujimoto et al.
2012/0114354 A1 5/2012 Saito et al.
2012/0114355 A1* 5/2012 Amemiya et al. ..... 399/67
2012/0121303 A1 5/2012 Takagi et al.
2012/0121304 A1 5/2012 Tokuda et al.
2012/0121305 A1 5/2012 Yoshikawa et al.
2012/0148303 A1 6/2012 Yamaguchi et al.
2012/0155935 A1 6/2012 Yoshikawa et al.
2012/0155936 A1 6/2012 Yamaguchi et al.
2012/0177388 A1 7/2012 Imada et al.
2012/0177393 A1 7/2012 Ikebuchi et al.
2012/0177420 A1 7/2012 Shimokawa et al.
2012/0177423 A1 7/2012 Imada et al.
2012/0177424 A1 7/2012 Saito et al.
2012/0207523 A1 8/2012 Ueno et al.
2012/0219312 A1 8/2012 Yuasa et al.
2012/0224878 A1 9/2012 Ikebuchi et al.
2012/0237273 A1 9/2012 Yoshinaga et al.

FOREIGN PATENT DOCUMENTS

JP 2000-352890 12/2000
JP 2004226807 A * 8/2004
JP 2005-070510 3/2005
JP 2007-079040 3/2007
JP 2007-233011 9/2007
JP 2007-334205 12/2007
JP 2008-129517 6/2008
JP 2010-032625 2/2010
JP 2010-079309 4/2010

OTHER PUBLICATIONS

U.S. Appl. No. 13/557,841, filed Jul. 25, 2012, Toshihiko Shimokawa, et al.

* cited by examiner

*Primary Examiner* — Susan Lee
(74) *Attorney, Agent, or Firm* — Oblon, McClelland, Maier & Neustadt, L.L.P.

(57) ABSTRACT

A fixing device includes a heat source; a fixing member looped into a generally cylindrical shape to rotate in a circumferential direction thereof and partially heated by the heat source and to heat a surface of a recording medium bearing an unfixed toner image to fix the unfixed toner image thereon in a fixing process; a rotary pressing member disposed facing the fixing member to form a nip therebetween, through which the recording medium is transported in a transport direction; and a rotation driver to rotate one of the fixing member and the pressing member. In a case in which the fixing member is halted for a reason other than the fixing process while power of the fixing device is on, electric power is not supplied to the heat source and the fixing member is rotated by a predetermined amount or more after the fixing member is halted.

22 Claims, 9 Drawing Sheets

FIXING DEVICE AND IMAGE FORMING APPARATUS INCLUDING SAME

CROSS-REFERENCE TO RELATED APPLICATIONS

This patent application is based on and claims priority pursuant to 35 U.S.C. §119 from Japanese Patent Application Nos. 2012-026059, filed on Feb. 9, 2012, and 2012-279346, filed on Dec. 21, 2012, both in the Japan Patent Office, which are hereby incorporated herein by reference in their entirety.

BACKGROUND OF THE INVENTION

1. Field of the Invention

Exemplary aspects of the present disclosure generally relate to a fixing device and an image forming apparatus, and more particularly, to a fixing device for fixing a toner image on a recording medium and an image forming apparatus including the fixing device.

2. Description of the Related Art

Related-art image forming apparatuses, such as copiers, facsimile machines, printers, or multifunction printers having at least one of copying, printing, scanning, and facsimile capabilities, typically form an image on a recording medium according to image data. Thus, for example, a charger uniformly charges a surface of an image bearing member (which may, for example, be a photosensitive drum); an optical writer projects a light beam onto the charged surface of the image bearing member to form an electrostatic latent image on the image bearing member according to the image data; a developing device supplies toner to the electrostatic latent image formed on the image bearing member to render the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

The fixing device used in such image forming apparatuses may employ a fixing member inside which a heater is provided and a pressing roller pressed against the fixing member to form a fixing nip therebetween. As a recording medium bearing a toner image passes through the fixing nip, the fixing member heated by the heater and the pressing roller apply heat and pressure to the recording medium to melt and soften toner in the toner image, thereby fixing the toner image to the recording medium.

When heating the fixing member at a predetermined temperature by a heat source, if the desired temperature of the fixing member is achieved in a short period of time, a preheating process in a standby state can be shortened or even omitted, thereby allowing significant reduction in consumption of energy. In view of the above, the fixing member employs parts having a low heat capacity such as a thin roller and a thin belt formed of a metal base member on which an elastic rubber layer is disposed. Furthermore, in order to heat the fixing member quickly, a heat source such as a ceramic heater, a halogen heater that heats the fixing member using radiant heat, and an IH (induction heating) type heater with high heating efficiency is used.

In such a known fixing device using the heat sources described above and in a known fixing device in which a fixing member is heated locally such as in a localized-heating type fixing device, an area (heated area) heated by the heat source is located at a place other than the fixing nip portion at which the fixing member and an opposing member such as a pressing roller meet and press against each other, and the unfixed toner image is fixed onto the recording medium under heat and pressure applied in the fixing nip. As a result, even when the fixing member is heated relatively high at the heated area, heat of the fixing device is taken away by the recording medium as the recording medium passes through the fixing nip during fixing operations.

This prevents excessive temperature rise of the fixing member. However, when rotation of the fixing member stops such as when the image forming apparatus is in an OFF-state or the fixing device is in an OFF-mode/sleep mode or energy-saving mode, or during abnormal operations such as paper jams and abrupt halting of the image forming apparatus, residual heat of the heat source keeps heating the fixing member even when the heat source is turned off. Even when the residual heat is not significant, residual heat of a reflector, a stay, and high-temperature internal air heats the fixing member after its rotation.

Furthermore, in a case in which the heated area of the fixing member is spaced apart a certain distance from the fixing nip portion, the heated portion of the fixing member is heated relatively high so as to ensure enough heat for fixing operations until the heated portion of the fixing member arrives at the fixing nip portion. Although advantageous, if the temperature of the fixing member remains high, the fixing member gets damaged. In particular, if the fixing member is formed of parts having a low heat capacity, such as a thin roller and a thin belt to shorten the warm-up time and reduce power consumption, the fixing member is damaged easily.

When the image forming apparatus equipped with the fixing device of the localized-heating type, the pressing member and a recording medium contacting the fixing member draw heat from the fixing member. However, other areas of the fixing member not contacting the pressing member and the recording medium, in particular, the area including the heated portion before entering the fixing nip portion, reserve heat due to a relatively low heat transfer ratio in the circumferential direction. As a result, deformation or thermal expansion occurs at the area.

A relatively large temperature deviation in the circumferential direction of the fixing member causes a difference in the degree of thermal expansion at a high-temperature area and at a low-temperature area. If the difference between the high-temperature area and the low-temperature area is significant, deformation also known as a kink which is a depression formed in the fixing member occurs in the center of the high-temperature area of the fixing member. Although the deformation is caused by local thermal expansion, the degree of which depends on the material and the thickness of the fixing member, such deformation in the fixing member causes an image defect as well as damage to the fixing member.

In view of the above, there is demand for a fixing device capable of preventing deformation of a fixing member even when the fixing member stops abruptly and the temperature thereof increases excessively.

SUMMARY OF THE INVENTION

In view of the foregoing, in an aspect of this disclosure, there is provided an improved fixing device including a heat source, a fixing member, a rotary pressing member, and a rotation driver. The fixing member is looped into a generally cylindrical shape to rotate in a circumferential direction thereof and partially heated by the heat source. The fixing member heats a surface of a recording medium bearing an unfixed toner image to fix the unfixed toner image thereon in a fixing process. The rotary pressing member is disposed facing the fixing member to form a nip therebetween, through which the recording medium is transported in a transport direction. The rotation driver rotates one of the fixing member and the pressing member. In a case in which the fixing member is halted for a reason other than the fixing process while power of the fixing device is on, electric power is not supplied to the heat source and the fixing member is rotated by a predetermined amount or more after the fixing member is halted.

According to another aspect, an image forming apparatus includes the fixing device.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF THE INVENTION

Figure 1:
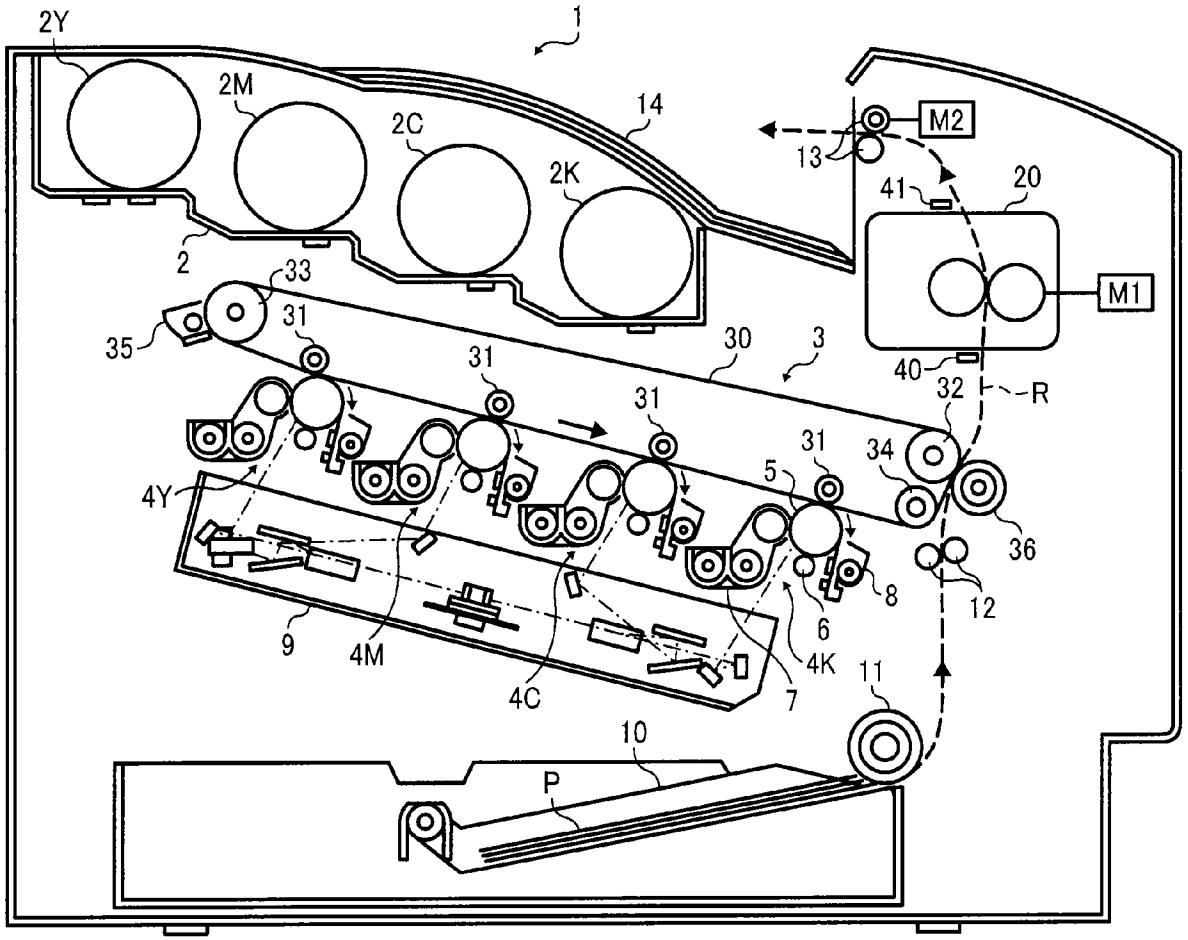
FIG. 1 is a schematic diagram illustrating a tandem-type color laser printer as an example of an image forming apparatus according to an illustrative embodiment of the present invention.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, and initially with reference to FIG. 1, a description is provided of an image forming apparatus according to an aspect of this disclosure.

FIG. 1 is a schematic diagram illustrating an image forming apparatus 1 according to an illustrative embodiment of the present invention. The image forming apparatus 1 illustrated in FIG. 1 is an example of a tandem-type color laser printer, and at the middle of the main body, four image forming units 4Y, 4M, 4C, and 4K are disposed. The respective image forming units 4Y, 4M, 4C, and 4K all have the same configurations as all the others, except for developers of different colors: yellow (Y), magenta (M), cyan (C), and black (K), which correspond to color separation components of a color image.

It is to be noted that reference characters Y, M, C, and K denote the colors yellow, magenta, cyan, and black, respectively. To simplify the description, the reference characters Y, M, C, and K indicating colors are omitted herein unless otherwise specified.

More specifically, each of the image forming units 4Y, 4M, 4C, and 4K is provided with a drum-shaped photosensitive member (hereinafter referred to simply as a photosensitive drum) 5 as a latent image bearing member, a charging unit 6 that charges the surface of the photosensitive drum 5, a development unit 7 that supplies toner to the surface of the photosensitive drum 5, a cleaning unit 8 that cleans the surface of the photosensitive drum 5, and so forth. It is to be noted that in FIG. 1, reference numbers are provided only to the photosensitive drum 5, the charging unit 6, the development unit 7, and the cleaning unit 8 included in the black image forming unit 4K, and the reference numbers are omitted for elements employed in the other image forming units 4Y, 4M, and 4C.

Below the image forming units 4Y, 4M, 4C, and 4K, there is provided an exposure unit 9 that exposes the surface of the photosensitive drum 5. The exposure unit 9 include a light source, a polygon mirror, an f-θ lens, a reflective mirror, and so forth, and illuminates the surface of each photosensitive drum 5 with laser light based on image data.

A transfer unit 3 is disposed substantially above the image forming stations 4Y, 4M, 4C, and 4K. The transfer unit 3 includes an intermediate transfer belt 30 serving as a transfer body, four primary transfer rollers 31, each serving as a primary transfer device, a secondary transfer roller 36 serving as a secondary transfer device, a secondary transfer backup roller 32, a cleaning backup roller 33, a tension roller 34, and a belt cleaning unit 35.

The intermediate transfer belt 30 is a belt formed into a loop and entrained about the secondary transfer backup roller 32, the cleaning backup roller 33, and the tension roller 34. Herein, rotation of the secondary transfer backup roller 32 causes the intermediate transfer belt 30 to move or rotate in a direction indicated by an arrow in FIG. 1.

The intermediate transfer belt 30 is interposed between each of the four primary transfer rollers 31 and the photosensitive drums 5, thereby forming a primary transfer nip therebetween. Further, each primary transfer roller 31 is connected to a power source, not illustrated, and a predetermined direct current (DC) voltage and/or an alternating current (AC) voltage are supplied to each primary transfer roller 31.

The intermediate transfer belt 30 is interposed between the secondary transfer roller 36 and the secondary transfer backup roller 32, thereby forming a secondary transfer nip therebetween. Moreover, similar to the primary transfer roller 31, the secondary transfer roller 36 is also connected to a power source, not illustrated, and a predetermined direct current voltage (DC) and/or an alternating current (AC) voltage are supplied to the secondary transfer roller 36.

In the upper portion of the main body, a bottle housing unit 2 is provided, and four toner bottles 2Y, 2M, 2C, and 2K that house supplemental toner are detachably mounted in the bottle housing unit 2. A toner supply path, not illustrated, is provided between each of the toner bottles 2Y, 2M, 2C, and 2K, and the respective developing units 7, and toner is supplied from the toner bottles 2Y, 2M, 2C, and 2K to the respective developing units 7 via the supply paths.

Meanwhile, in the lower part of the main body, there are provided a paper tray 10 that stores multiple recording media sheets P and a sheet feed roller 11 that picks up the recording medium P out of the paper tray 10, one sheet at a time. According to the present illustrative embodiment, other than ordinary paper, the recording medium includes, but is not limited to cardboard, a postcard, an envelope, thin paper, applied paper (coated paper, art paper, etc.), tracing paper, and an OHP sheet. Although not illustrated, a manual sheet feed system may be provided.

Inside the main body, a sheet transport path R is provided to deliver the recording medium P from the paper tray 10 to pass through the secondary transfer nip and ejects the paper to the outside of the apparatus. Upstream from the secondary transfer roller 36 in the sheet transport direction, there is provided a pair of registration rollers 12 serving as a delivery mechanism to deliver the recording medium P to the secondary transfer nip.

Downstream from the secondary transfer roller 36 in the sheet transport direction, there is provided a fixing unit 20 for fixing an unfixed image transferred to the recording medium P. Upstream from the fixing device 20 in the sheet transport direction, there is provided a first sheet detector 40 for detection of a recording medium. Downstream from the fixing device 20 there is provided a second sheet detector 41 for detection of a recording medium. With the first sheet detector 40 and the second sheet detector 41, a recording medium passing through the fixing device 20 is detected.

Moreover, downstream from the fixing unit 20 in the sheet transport path R in the sheet transport direction, there is provided a pair of sheet output rollers 13 for ejecting the recording medium P to the outside of the image forming apparatus 1. A first motor M1 for driving the fixing device 20 and a second motor M2 for driving the sheet output rollers 13 can operate independently. Furthermore, on the upper surface section of the main body of the image forming apparatus 1, an output paper tray 14 for catching and holding the recording medium P ejected to the outside of the image forming apparatus 1.

Next, with reference to FIG. 1, basic operations of the image forming apparatus 1 according to the present illustrative embodiment are described. Upon start of image formation, each of the photosensitive drums 5 in the image forming units 4Y, 4M, 4C, and 4K is rotated in a clockwise direction by a driving unit, not illustrated, and the surface of each photosensitive drum 5 is uniformly charged by the charging unit 6 to a predetermined polarity. The charged surface of each photosensitive drum 5 is illuminated with laser light projected from the exposure unit 9, to form an electrostatic latent image on the surface of each of the photosensitive drums 5. At this time, the image information exposed to each photosensitive drum 5 includes single-color image information decomposed into yellow, magenta, cyan and black color. In such a manner, toner is supplied by each developing unit 7 to the electrostatic latent image formed on each photosensitive drum 5, thereby forming the electrostatic latent image into a visible image, also known as a toner image.

Further, upon start of the image forming operation, the secondary transfer backup roller 32 is rotated in the counterclockwise direction in FIG. 1, to move the intermediate transfer belt 30 in the direction indicated by the arrow. Then, the primary transfer rollers 31 are supplied with a constant-voltage controlled or constant-current controlled voltage having the polarity opposite that of the charged toner. Accordingly, a transfer electric field is formed in the primary transfer nips between the primary transfer rollers 31 and the photosensitive drums 5.

When the toner image of the respective color formed on the photosensitive drums 5 arrives at the primary transfer nip as the photosensitive drums 5 rotate, the toner images on the photosensitive drums 5 are sequentially transferred onto the intermediate transfer belt 30 due to the transfer electric field formed in the primary transfer nips, such that they are superimposed one atop the other, thereby forming a composite toner image on the surface of the intermediate transfer belt 30. After transfer of the toner image, toner remaining on the photosensitive drums 5 which was not transferred to the intermediate transfer belt 30 is removed by the cleaning unit 8. Remaining charge on the surface of the photosensitive drums 5 is then removed by a charge neutralizer, not illustrated, to initialize a surface potential.

In the lower part of the image forming apparatus 1, the sheet feed roller 11 starts to rotate, and the recording medium P is fed from the paper tray 10 to the sheet transport path R. The recording medium P fed to the sheet transport path R is delivered to the secondary transfer nip between the secondary transfer roller 36 and the secondary transfer backup roller 32 at an appropriate timing adjusted by the pair of registration rollers 12. At this time, the secondary transfer roller 36 has been supplied with a transfer voltage having the opposite polarity to the charge polarity of the composite toner image on the intermediate transfer belt 30, thereby forming a transfer electric field in the secondary transfer nip.

When the composite toner image on the intermediate transfer belt 30 then reaches the secondary transfer nip as the intermediate transfer belt 30 rotates, the composite toner image on the intermediate transfer belt 30 is transferred onto the recording medium P by the transfer electric field formed in the secondary transfer nip. Further, at this time, the residual toner remaining on the intermediate transfer belt 30 which was not transferred to the recording medium P is removed by the belt cleaning unit 35, and the removed toner is delivered and collected to a waste toner bin, not illustrated.

Subsequently, the recording medium P is delivered to the fixing unit 20, and the toner image transferred on the recording medium P is fixed thereto by the fixing unit 20. The recording medium P is then output outside of the apparatus by the pair of sheet output rollers 13 and stacked on the output paper tray 14.

The above description pertains to image formation of a color image. It is also possible to form a monochrome image using any one of the four image forming units 4Y, 4M, 4C, and 4K, or to form an image of two or three colors by using two or three image forming units.

Figure 2:
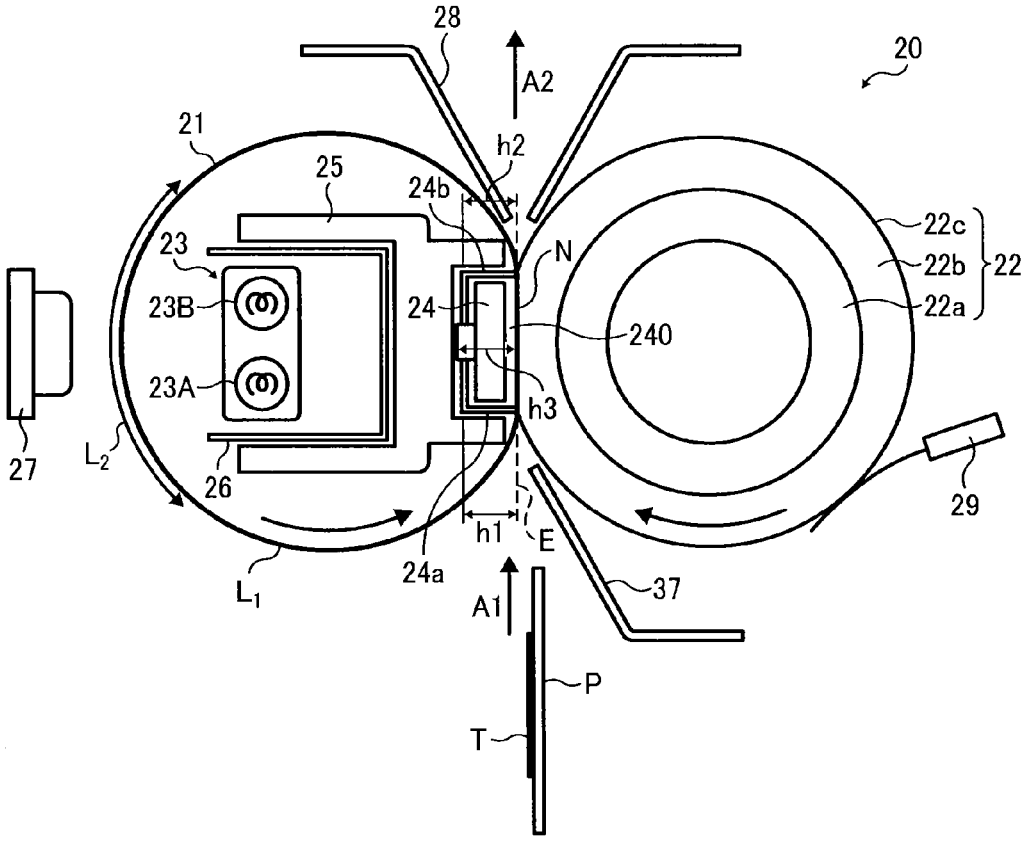
FIG. 2 is a cross-sectional view schematically illustrating a fixing device employed in the image forming apparatus of FIG. 1.

With reference to FIG. 2, a detailed description is provided of the fixing unit 20. As illustrated in FIG. 2, the fixing unit 20 includes a rotatable fixing belt 21 formed into a loop, serving as a fixing member; a rotatable pressing roller 22 as an opposing member disposed opposite the fixing belt 21; a halogen heater 23 serving as a heat source that heats the fixing belt 21; a nip forming member 24 disposed inside the fixing belt 21; a stay 25 disposed inside the fixing belt 21, serving as a support member for supporting the nip forming member 24; a reflective member 26 that reflects light emitted from the halogen heater 23 against the fixing belt 21; a thermopile 27 serving as a temperature detector for detecting the temperature of the fixing belt 21; a thermistor 29 serving as a temperature detector for detecting the temperature of the pressing roller 22; a separation member 28 for separating a recording medium from the fixing belt 21; and a pressing/depressurization mechanism, not illustrated, for pressing the pressing roller 22 against the fixing belt 21, and so forth.

The fixing belt 21 is formed of a thin, flexible endless-shaped belt (including a film) member. More specifically, the fixing belt 21 includes a base member constituting an inner peripheral side thereof formed of a material with a large thermal expansion coefficient such as nickel and SUS, and a separating layer that constitutes an outer peripheral side formed of tetrafluoroethylene-perfluoroalkylvinylether copolymer (PFA) or polytetrafluoroethylene (PTFE). An elastic layer made of a rubber material such as silicone rubber, foam silicone rubber and fluoro-rubber may be provided between the base member and the separating layer.

The pressing roller 22 is formed of a metal cored bar 22*a*, an elastic layer 22*b* made of foam silicone rubber, silicone rubber or fluoro-rubber which is provided on the surface of the metal cored bar 22*a*, and a separating layer 22*c* made of PFA or PTFE which is provided on the surface of the elastic layer 22*b*. The pressing roller 22 is pressed against the fixing belt 21 by a pressing mechanism, not illustrated, and is in contact with the nip forming member 24 via the fixing belt 21. At a place where the pressing roller 22 and the fixing belt 21 meet and press against each other, the elastic layer 22*b* of the pressing roller 22 is pressed against the fixing belt 21 so as to form a nip portion N with a predetermined width.

The pressing roller 22 is rotated by a drive source such as motor disposed in the main body of the image forming apparatus 1. When the pressing roller 22 is rotated, the driving force is transmitted to the fixing belt 21 at the nip portion N, causing the fixing belt 21 to rotate.

In the present illustrative embodiment, the pressing roller 22 is a hollow roller, but it may be a solid roller. A heat source such as a halogen heater may be disposed inside the pressing roller 22. Furthermore, in a case in which the pressing roller 22 does not include the elastic layer 22*b*, a heat capacity becomes less, thereby improving fixing properties, but when unfixed toner is pressed against the recording medium P, minute asperities on the belt surface may show up in a resulting output image and hence uneven brightness may occur in the solid part of the output image.

In view of this, the elastic layer 22*b* has desirably a thickness of not smaller than 100 μm. The elastic layer 22*b* with a thickness of equal to or smaller than 100 μm can absorb asperities of the belt by deforming elastically, thereby preventing uneven brightness. The elastic layer 22*b* may be solid rubber, but sponge rubber may be used if the pressing roller 22 does not include the heat source inside thereof. The sponge rubber is more preferred since it enhances thermal insulation properties to maintain the temperature of the fixing belt 21. Furthermore, according to the present illustrative embodiment, the fixing member and the pressing member press against each other, but may simply contact one another without pressing each other.

According to the present illustrative embodiment, the halogen heater 23 includes two halogen heaters: a halogen heater 23A as a first halogen heater and a halogen heater 23B as a second halogen heater (which may be collectively referred to as halogen heater 23). Both ends of each of the halogen heaters 23A and 23B are fixed to a side plate (not illustrated) of the fixing unit 20. A power source unit provided in the main body of the image forming apparatus 1 controls output of the halogen heaters 23A and 23B to generate heat, and the output control is performed based on the temperature of the surface of the fixing belt 21 detected by the thermopile 27. Such output control on the halogen heaters 23A and 23B sets the temperature (i.e., a fixing temperature) of the fixing belt 21 to a desired temperature.

Figure 3:
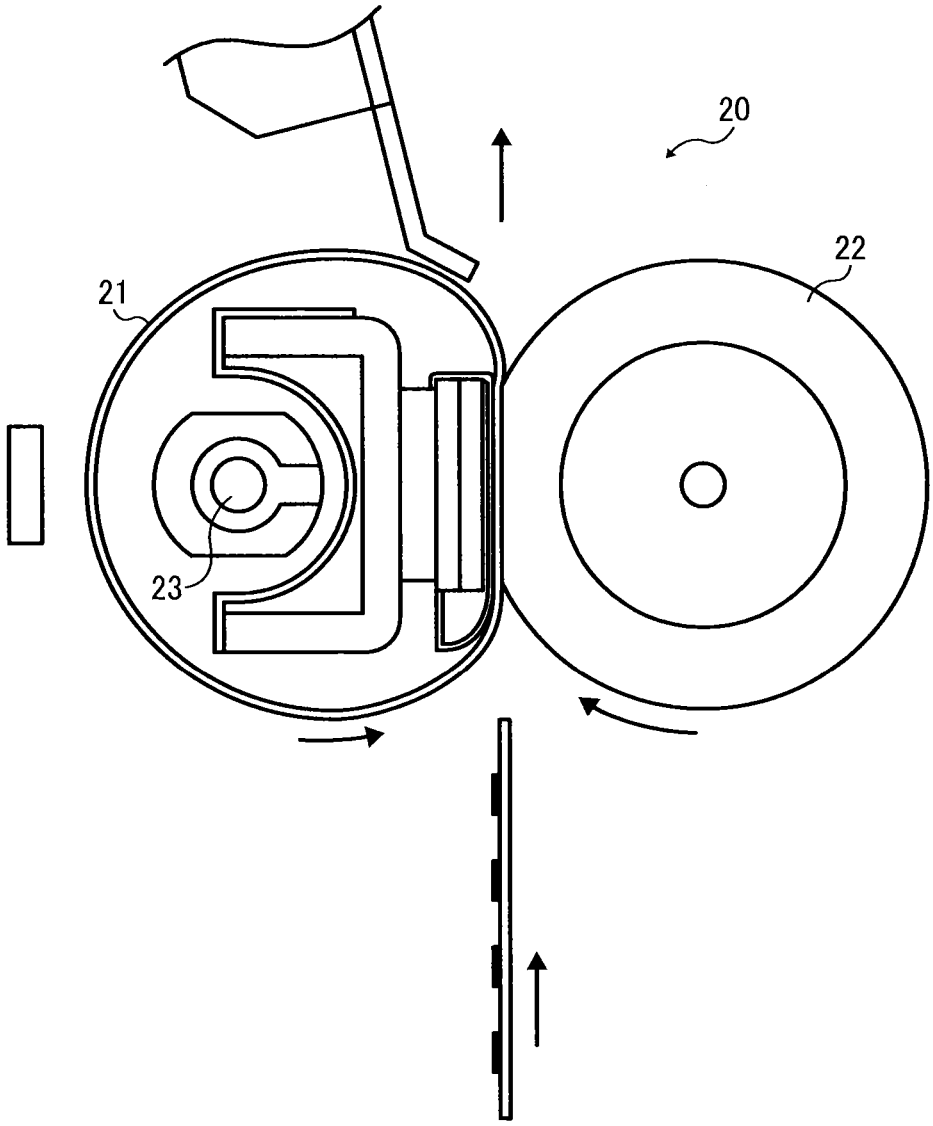
FIG. 3 is a cross-sectional view schematically illustrating the fixing device including a halogen heater serving as a heat source.
Figure 4:
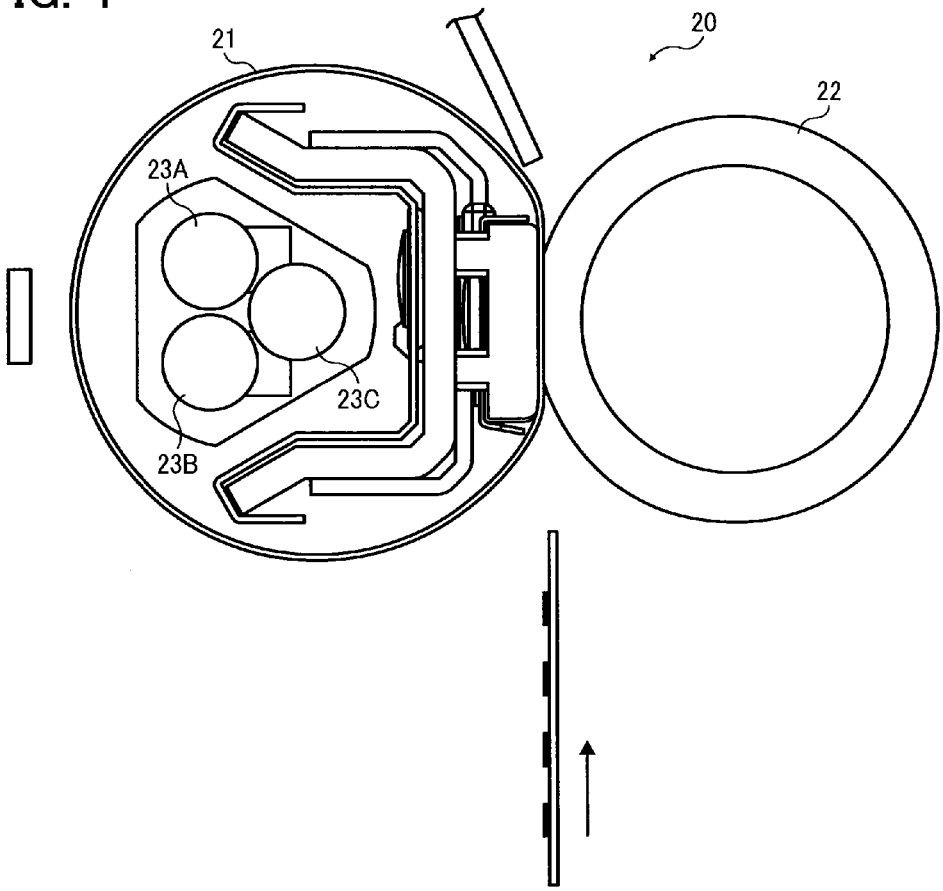
FIG. 4 is a cross-sectional view schematically illustrating the fixing device including three halogen heaters.

It is to be noted that the number of halogen heaters is not limited to three. For example, as illustrated in FIG. 3, a single heater (23) capable of heating the entire fixing belt 21 in the width direction, which is a maximum feedable width of a recording medium, may be employed. Alternatively, more than three heaters may be employed to heat different portions of the fixing belt 21 in the width direction to accommodate different widths of the recording media P. A heating element of the heater is not limited to a halogen heater, but any other suitable heater such as a ceramic heater may be employed.

The nip forming member 24 extends along the axial direction of the fixing belt 21 or the pressing roller 22 and is fixedly supported by the stay 25. With this configuration, the nip forming member 24 can reliably support pressure from the pressing roller 22 and is prevented from bending. A uniform nip width can be achieved over the axial direction of the pressing roller 22. It is desirable that in order to prevent deformation of the nip forming member 24, the stay 25 be formed of a metal material with high mechanical strength, such as stainless steel and iron. Furthermore, the stay 25 has a horizontally long cross section extending in the pressing direction of the pressing roller 22, thereby increasing the section modulus and hence enhancing the mechanical strength of the stay 25.

Furthermore, the nip forming member 24 is formed of a heat resistant member with a heat resistant temperature of not lower than 200° C. With this configuration, deformation of the nip forming member 24 due to heat is prevented in a toner fixing temperature range, thereby reliably maintaining a desirable condition of the nip portion N and hence stabilizing quality of an output image. For the nip forming member 24, a general heat resistant resin including, but not limited to polyether sulfone (PES), polyphenylene sulfide (PPS), liquid crystal polymer (LCP), polyether nitrile (PEN), polyamide imide (PAI), and polyether ether ketone (PEEK), may be used. According to the present illustrative embodiment, LCP is used for the nip forming member 24.

As illustrated in FIG. 2, the surface of the nip forming member 24 is provided with a low-friction sheet 240. As the fixing belt 21 rotates, the fixing belt 21 slidably moves along the low-friction sheet 240, thereby reducing a driving torque generated in the fixing belt 21. Accordingly, load on the fixing belt 21 due to a frictional force is reduced.

The reflective member 26 is disposed between the stay 25 and the halogen heater 23. As the reflective member 26 is disposed in such a manner, light projected from the halogen heater 23 towards the stay 25 is reflected onto the fixing belt 21. This can increase an amount of light that illuminates the fixing belt 21, thereby heating efficiently the fixing belt 21. Further, since it is possible to suppress transmission of radiant heat from the halogen heater 23 to the stay 25 and so forth, consumption of energy can be reduced.

According to the present illustrative embodiment, in order to achieve an energy-efficient fixing operation with a short first print time, the fixing device 20 employs a direct heating method in which the fixing belt 21 is directly heated by the halogen heater 23 at a place other than the nip portion N.

In the present illustrative embodiment, nothing is placed between the halogen heater 23 and the left-side portion of the fixing belt 21 of FIG. 2, thereby heating directly the fixing belt 21 with radiant heat from the halogen heater 23.

Furthermore, in order to achieve a low heat capacity, the fixing belt 21 is made thin and has a small diameter. More specifically, respective thicknesses of the base member, the elastic layer, and the separating layer constituting the fixing belt 21 are configured to be in a range of from approximately 20 μm to 100 μm, 100 μm to 300 μm, and 5 μm to 50 μm, respectively. Moreover, the diameter of the fixing belt 21 is in a range of from approximately 20 mm to 40 mm. Still further, in order to obtain a low heat capacity, a total thickness of the fixing belt 21 is preferably equal to or less than approximately 0.4 mm, and more preferably, equal to or less than approximately 0.2 mm. Moreover, preferably, the diameter of the fixing belt 21 is equal to or less than 30 mm. The elastic layer is fired on the base and coated with the separating layer.

It is to be noted that in the present illustrative embodiment, the diameter of the pressing roller 22 is in a range of from approximately 20 to 40 mm, and the diameter of the fixing belt 21 and the diameter of the pressing roller 22 are configured to be similar or the same. However, the configuration of the fixing belt 21 and the pressing roller 22 is not limited to this. For example, the diameter of the fixing belt 21 may be smaller than the diameter of the pressing roller 22. In that case, a curvature of the fixing belt 21 at the nip portion N becomes larger than a curvature of the pressing roller 22, thereby stripping the recording medium P being output from the nip portion N easily from the fixing belt 21.

Furthermore, as a result of making the diameter of the fixing belt 21 small as described above, the space inside the fixing belt 21 becomes small, but in the present illustrative embodiment, the stay 25 is formed in a concave shape with both end sides bent, and the halogen heater 23 is housed inside that portion formed in the concave shape, thereby allowing the stay 25 and the halogen heater 23 to be disposed even inside the small space of the fixing belt 21.

Moreover, in order to make the stay 25 as large as possible within the given small space, the nip forming member 24 is formed compact. More specifically, the width of the nip forming member 24 in the sheet transport direction is narrower than the width of the stay 25 in the sheet transport direction. Furthermore, in FIG. 2, when heights of the nip forming member 24 at an upstream-side end 24*a* in the sheet transport direction and at a downstream-side end 24*b* with respect to the nip portion N (or its virtual extended line E) are referred to as h1 and h2, and when the maximum height of the portion of the nip forming member 24 other than the upstream-side end 24*a* and the downstream-side end 24*b* at the nip portion N (or its virtual extended line E) is referred to as h3, the following relation is satisfied: $h1 \leq h3$ and $h2 \leq h3$.

With this configuration, the upstream end 24*a* and the downstream end 24*b* of the nip forming member 24 are not positioned between the fixing belt 21 and the respective bent sections of the stay 25 on the upstream side and the downstream side in the sheet transport direction, and hence the respective bent sections can be brought close to the inner peripheral surface of the fixing belt 21. This allows the stay 25 to take up as much area as possible inside the limited space inside the fixing belt 21, thereby ensuring the strength of the stay 25. Consequently, it is possible to prevent deformation of the nip forming member 24 caused by the pressing roller 22, thereby enhancing fixing properties.

Still referring to FIG. 2, basic operations of the fixing device 20 according to the present illustrative embodiment is described below. When the power of the main body of the image forming apparatus 1 is turned on, electric power is supplied to the halogen heater 23, while the pressing roller 22 starts to rotate in the clockwise direction in FIG. 2. Thereby, the fixing belt 21 is rotated counterclockwise in FIG. 2 due to frictional contact with the pressing roller 22.

Subsequently, by the above-described image formation process, the recording medium P bearing an unfixed toner image T is delivered in a direction of an arrow A1 of FIG. 2 while being guided by a guide plate 37 and enters the nip portion N between the fixing belt 21 and the pressing roller 22 pressingly contacting the fixing belt 21. Then, the toner image T is fused and fixed to the surface of the recording medium P by the heat applied by the fixing belt 21 heated by the halogen heater 23 and pressure between the fixing belt 21 and the pressing roller 22.

The recording medium P, on which the toner image T is fixed, is carried out of the nip portion N in a direction of an arrow A2 in FIG. 2. At this time, the tip of the recording medium P comes into contact with the tip of the separation member 28 which then separates the recording medium P from the fixing belt 21. Subsequently, the separated recording medium P is output to the outside of the apparatus by the sheet output rollers 13 and stacked onto the output paper tray 14 as described above.

According to an illustrative embodiment, immediately after the trailing edge of the recording medium P exits the nip portion N and while the recording medium P is transported by the sheet output rollers 13, the first motor M1 is halted to stop rotation of the fixing belt 21. In known image forming apparatuses, generally, the fixing device and the sheet output rollers are driven by the same motor, rotating and stopping the fixing roller and the sheet output rollers at the same time. By contrast, according to an illustrative embodiment of the present invention, the pressing roller 22 and the sheet output rollers 13 are rotated independently by independent motors, that is, the first motor M1 and the second motor M2. With this configuration, the pressing roller 22 can be stopped while the sheet output rollers 13 are rotated. In other words, the first motor M1 can be stopped temporarily while the second motor M2 rotates.

By stopping the first motor M1 immediately after the trailing edge of the recording medium P exits the nip N, a time during which the pressing roller 22 is rotated is shortened, as compared with the known fixing devices in which the fixing device and the sheet output rollers are driven and stopped at the same time. The first motor M1 needs to rotate not only the pressing roller 22, but also the fixing belt 21. The fixing belt 21 sliding against the nip forming member secured at the side plate causes resistance therebetween, resulting in large power consumption of the first motor M1. Therefore, by stopping the first motor M1 temporarily after the entire recording medium P exits the nip N and while the second motor M2 is driven, the driving time of the first motor M1 is shortened, thereby achieving the energy-efficient fixing device. The first motor M1 can be stopped temporarily each time the recording medium passes during continuous printing or after a plurality of recording media P passes.

According to the present illustrative embodiment, the sheet output rollers 13 and the pressing roller 22 are independently driven and stopped by two different motors. However, as long as the sheet output rollers 13 and the pressing roller 22 are independently driven and stopped, the configuration is not limited to the above. Alternatively, the sheet output rollers 13 and the pressing rollers 22 may be driven by the same motor. In such a case, a clutch is disposed in a torque transmission path from the motor to the rollers. By switching the clutch, movement of the rollers is independently controlled. With this configuration, the same effect as that of the foregoing embodiments can be achieved as well.

Figure 5:
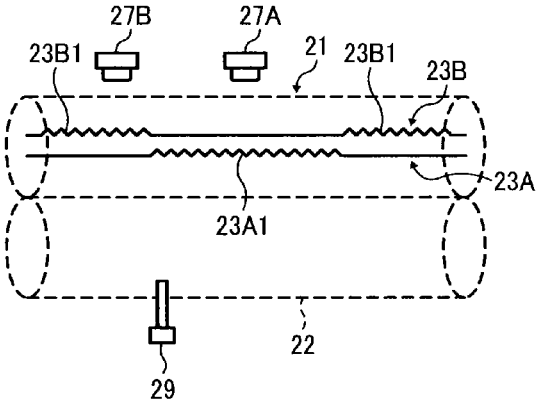
FIG. 5 is a schematic diagram illustrating a plurality of heat sources (halogen heaters) and a temperature detector (e.g., a thermopile and a thermistor) employed in the fixing device.

With reference to FIG. 5, a description is provided of the fixing device including two halogen heaters, that is, a first halogen heater 23A and a second halogen heater 23B to heat the fixing belt 21 in the axial direction thereof. In FIG. 5, heat generating positions of the first halogen heater 23A is different from that of the second halogen heater 23B. More specifically, a heat generating (light emitting) portion 23A1 of the first halogen heater 23A is located substantially at the center thereof, extending to a certain distance in the longitudinal direction. The heat generating portion of the second halogen heater 23B is located at both ends thereof in the longitudinal direction.

In the present illustrative embodiment, the length of the heat generating portion 23A1 of the first halogen heater 23A is in a range of from approximately 200 mm to 220 mm in the center thereof in the longitudinal direction with the center taken as an axis of symmetry. The second halogen heater 23B includes a heat generating (light emitting) portion 23B1 at both ends thereof in the longitudinal direction. According to the present illustrative embodiment, the heat generating portions 23B1 of the second halogen heater 23B are disposed outside an area corresponding to the heat generating portion 23A1 of the first halogen heater 23A so as to heat end portions of the fixing belt 21 in the width (axial) direction thereof.

While a sheet-passage width of A3-portrait and A4-landscape recording media is approximately 297 mm, the total length of the heat generating portion 23A1 of the first halogen heater 23A and the heat generating portion 23B1 of the second halogen heater 23B is in a range of from 300 mm to 330 mm, which means that the total heat generating length is longer than the sheet-passage width described above. A quantity of heat at both ends of the heat generating portions 23B1 tends to be less than other places (that is, luminous intensity is low), causing the temperature to drop. Thus, it is necessary to use certain areas of the heat generating portion having a certain quantity of heat (luminous intensity) or greater as the sheet passage region.

According to the present illustrative embodiment as illustrated in FIG. 5, two thermopiles (i.e., a first thermopile 27A and a second thermopile 27B) are provided to detect the temperature of the fixing belt 21. The first thermopile 27A detects the temperature of the substantially center of the fixing belt 21 corresponding to the heat generating portion 23A1 of the first heater 23A. The second thermopile 27B detects the temperature of the end portions of the fixing belt 21 corresponding to the heat generating portions 23B1 of the second heater 23B.

Figure 6:
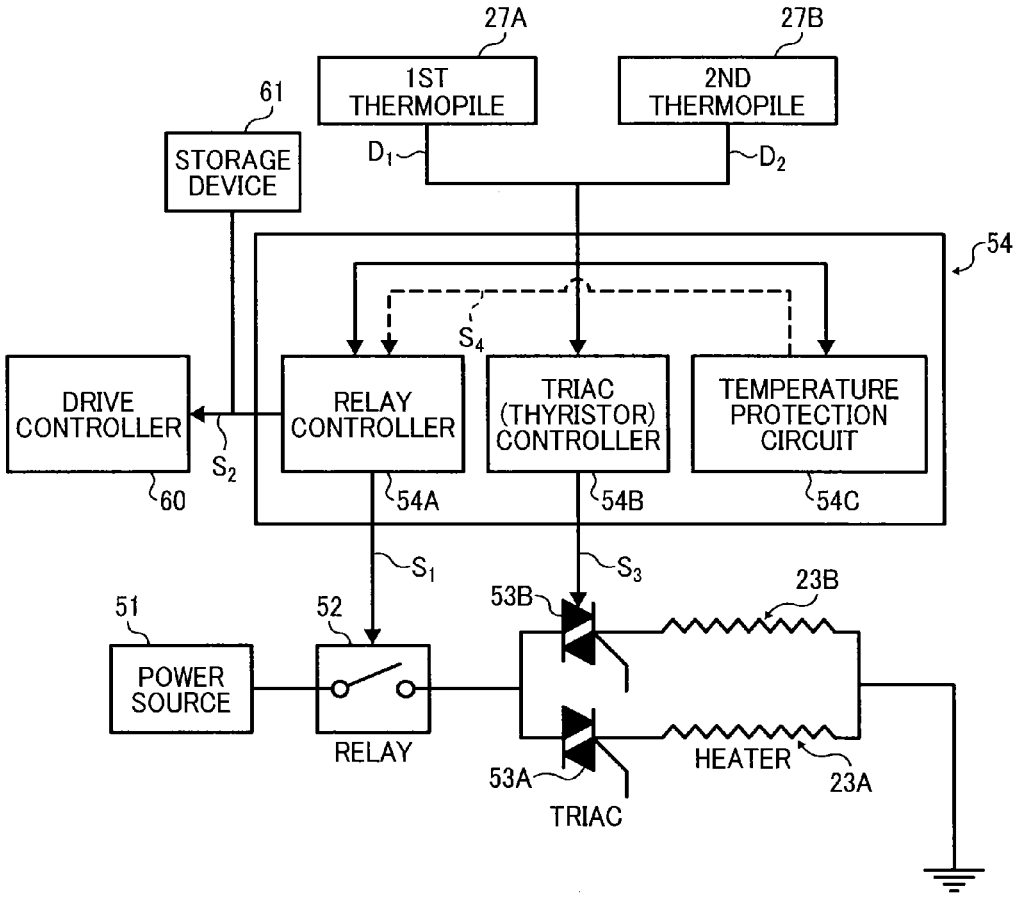
FIG. 6 is a block diagram of a temperature control circuit employed in the fixing device.

With reference to FIG. 6, a description is provided of temperature control of the fixing device 20. FIG. 6 is a block diagram of a temperature control circuit of the fixing device 20. Electric power supplied from a power source 51 is supplied to the first halogen heater 23A and the second halogen heater 23B via a relay 52, and triacs 53A and 53B. At certain times such as during warm-up, print-job execution, ready standby mode, and the like, the relay 52 is switched on. At other times such as during power-OFF state, OFF-mode, energy-saving mode, a sudden stop, and the like, the relay 52 is switched off.

Each of the triacs 53A and 53B adjusts supply of power to the first halogen heater 23A and the second halogen heater 23B and feeds back temperature information of the temperature of the fixing belt 21 detected by the first thermopile 27A and the second thermopile 27B. The ready standby mode herein refers to a state in which printing is started immediately after receiving a print job command. In this state, a software and a hardware including, but not limited to, an engine software and a controller, that activate the apparatus have been started. Generally, the motor for the fixing device 20 is stopped in this state, but the temperature of the fixing belt 21 is maintained at a certain level so that the fixing device 20 can pass the recording medium P immediately.

A temperature control unit 54 includes a relay controller 54A for controlling the relay 52, a triac controller 54B for controlling the triacs 53A and 53B, and a temperature protection circuit 54C that outputs an abnormal stop signal when the temperature of the fixing belt 21 rises excessively. The temperature information of the center and the end portions of the fixing belt 21 detected by the first thermopile 27A and the second thermopile 27B is provided to the temperature control unit 54, as temperature information values (voltage) $D_1$ and $D_2$. According to the present illustrative embodiment, the relay controller 54A outputs, based on the temperature information $D_1$ and $D_2$, an ON/OFF control signal S1 to the relay 52 and outputs a drive control signal S2 to a drive controller 60 of the pressing roller 22.

The triac controller 54B provides a power control signal S3 to the triacs 53A and 53B based on the temperature information $D_1$ and $D_2$. The temperature protection circuit 54C provides an abnormal stop signal S4 to the relay controller 54A based on the temperature information $D_1$ and $D_2$.

Furthermore, a storage device 61 that stores information on recording media P such as lengths of recording media P in the sheet transport direction is provided. In accordance with the information stored in the storage device 61, an amount of reverse rotation of the fixing belt 21 is determined, and a drive control signal is output to the pressing roller 22.

It is to be noted that the configuration of the temperature control circuit of the fixing device 20 is not limited to the configuration described above.

As described above, the low-heat capacity fixing belt 21 is heated directly, and the reflective member 26 limits the range of heat radiation relative to the fixing belt 21. In this configuration, in a case in which the first motor M1 stops, hence stopping rotation of the fixing belt 21, if the halogen heater 23 continues to heat the fixing belt 21, the temperature of the fixing belt 21 becomes too high instantly, thereby damaging the fixing belt 21.

In view of the above, when the first motor M1 is to be stopped temporarily, the halogen heater 23 is turned off before the first motor M1 is stopped. That is, while the first motor M1 is stopped, the halogen heater 23 is always turned off. The temperature control unit 54 provides the respective control signals to the triacs 53A and 53B to change the state of the halogen heater 23. The halogen heater 23 is turned off after the recording medium P passes through the nip portion N completely or while the trailing edge of the recording medium P is still in the nip portion N.

The halogen heater 23 is formed of a glass tube in which a heater and a halogen are sealed. After the heater is turned off, heat accumulated in the glass tube is released. In this configuration, using the halogen heater as a heat source, the fixing belt 21 gets heated temporarily with residual heat in the glass tube even after the heater is turned off. As the recording medium P passes through the nip portion N, the recording medium P takes the heat away from the fixing belt 21. However, after the trailing edge of the recording medium P exits the fixing nip N, the heat is no longer released via the recording medium P, causing the temperature of the fixing belt 21 to rise.

Figure 7A:
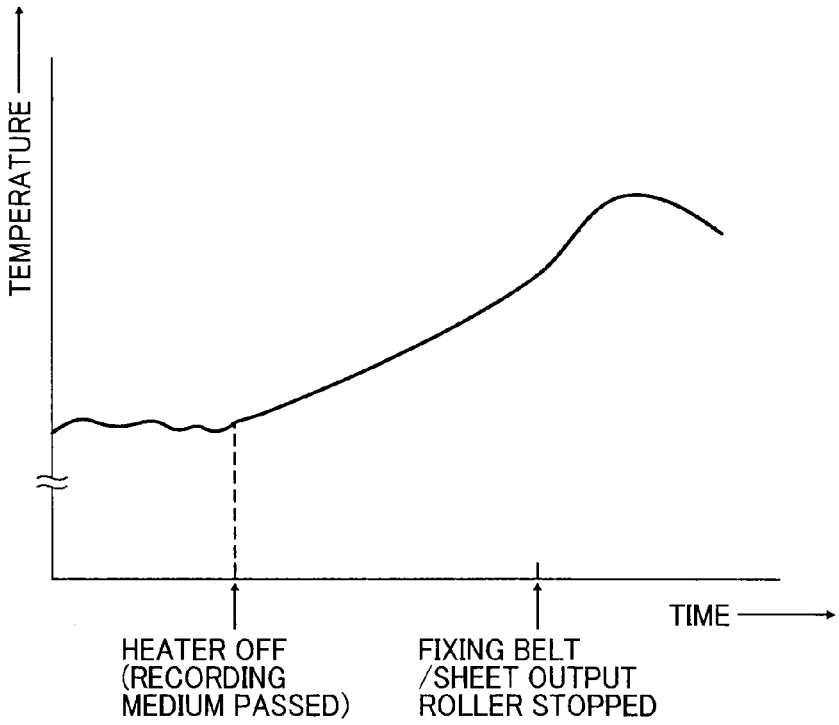
FIG. 7A is a graph showing a temperature change of a fixing belt of the fixing device in a case in which the fixing belt is rotated until rotation of a sheet output roller stops after the heater is turned off.
Figure 7B:
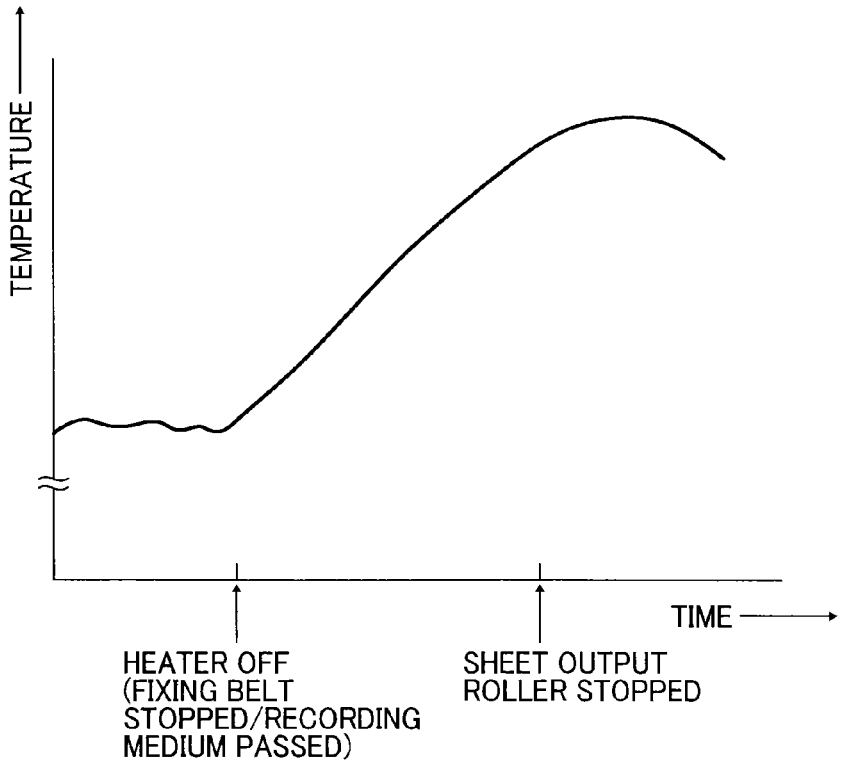
FIG. 7B is a graph showing a temperature change of the fixing belt in a case in which rotation of the fixing belt is stopped at the same time when the heater is turned off.

With reference to FIGS. 7A and 7B, a description is provided of a temperature change of the fixing belt 21 according to the illustrative embodiments of the present invention. FIG. 7A is a graph showing a temperature change of the fixing belt 21 in a case in which after the halogen heater 23 is turned off the fixing belt 21 is rotated until rotation of the pair of sheet output rollers 13 stops. FIG. 7B is a graph showing a temperature change of the fixing belt 21 in a case in which rotation of the fixing belt 21 is stopped substantially at the same time when the halogen heater 23 is turned off. It is to be noted that FIGS. 7A and 7B both show an example of a case in which passing of the recording medium P is completed at the same time when the halogen heater 23 is turned off.

As shown in FIG. 7A, the degree by which the temperature of the fixing belt 21 rises is moderate because the fixing belt 21 keeps rotating after the heater is turned off and thus heat is released. By contrast, as shown in FIG. 7B, the temperature of the fixing belt 21 rises rapidly because rotation of the fixing belt 21 is stopped at the same time when the heater is turned off and heat is not released. Depending on accumulation of the heat in the fixing belt 21, the temperature may exceed an upper limit temperature, damaging the fixing belt 21.

Figure 8:
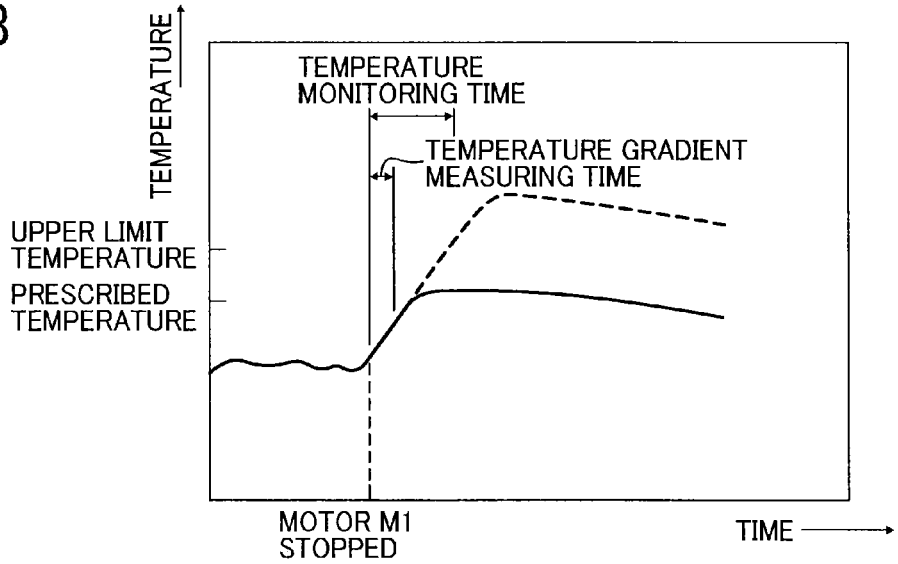
FIG. 8 is a graph showing a temperature change of the fixing belt in a case in which the temperature of the fixing belt is monitored after a motor for driving the fixing belt is stopped, and the fixing belt is rotated as necessary.

In view of the above, according to the illustrative embodiments, after rotation of the fixing belt 21 is stopped, heat of the fixing belt 21 is released based on a detection result provided by the thermopile 27 serving as the temperature detector. Heat can be released by rotating the fixing belt 21 by the first motor M1, for example. More specifically, as illustrated in FIG. 8, after the first motor M1 is stopped, the temperature of the fixing belt 21 is monitored for a certain time period, and if the temperature information values $D_1$ and $D_2$ indicating the temperature of the fixing belt 21 are equal to or higher than a prescribed temperature which is lower than the upper limit temperature, the first motor M1 is activated to rotate the fixing belt 21 to release the heat. With this configuration, an excessive temperature rise of the fixing belt 21 is prevented as indicated by a solid line in FIG. 8. A broken line in FIG. 8 shows a hypothetical temperature change of the fixing belt 21 in a case in which rotation of the fixing belt 21 is stopped at the same time when the heater is stopped, and the fixing belt 21 remains still thereafter.

Figure 9:
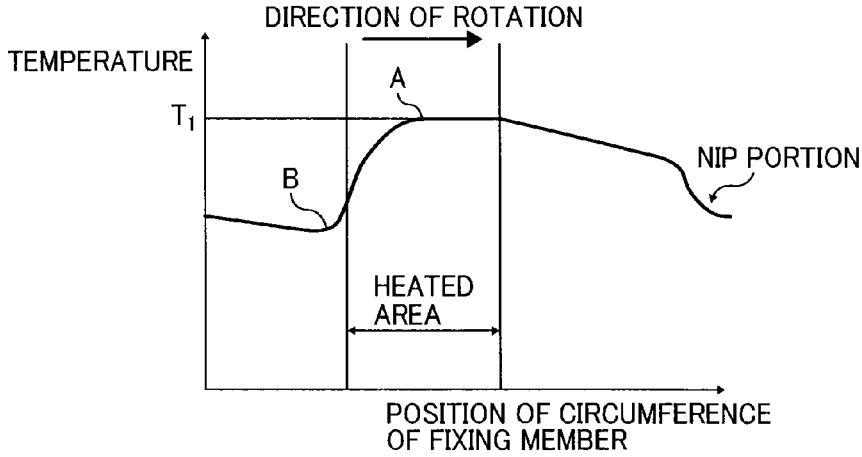
FIG. 9 is a graph showing a temperature distribution of the fixing belt in a circumferential direction thereof when the image forming apparatus stops abruptly and rotation of the fixing belt is halted.

With this configuration, when the relay shuts off and hence the apparatus stops suddenly due to paper jams or the like during imaging process, delivery of electrical power to the halogen heaters 23A and 23B is stopped and hence rotation of the fixing belt 21 is also stopped while the power source of the fixing device remains ON. FIG. 9 shows a temperature distribution of the fixing belt 21 in the circumferential direction thereof in this state.

Residual heat of the halogen heater 23 serving as a heat source heats the heated area of the fixing belt 21 (i.e., an area of an inner circumferential surface of the fixing belt 21 defined by the end portion of the reflective member 26 and the halogen heater 23, and heated by the reflected heat from the reflective member 26 and heated directly by the radiation of the halogen heater 23). As described above, as long as heat of the heated area of the fixing belt 21 is not taken away by the pressing member or the recording medium at the fixing nip portion N, the temperature of the heated area of the fixing belt 21 remains high, which results in thermal expansion in the excessive temperature rise state. More specifically, the thermal expansion occurs at a portion A in FIG. 9 which is the closest to the heat source.

By contrast, the areas, other than the heated area, do not expand thermally because of low thermal conductivity. More specifically, the temperature of a position B shown in FIG. 9 at the upstream side in the direction of rotation of the fixing belt 21 relative to the heated area is the lowest. Thus, expansion of the portion A of the fixing belt 21 is suppressed at the position B. As a result, the portion A does not expand completely, resulting in deformation of the fixing belt 21, that is, inward depression, also known as a kink. In other words, the temperature difference between the positions A and B causes the deformation (kink) described above.

In a case in which the image forming apparatus stops suddenly and rotation of the fixing belt 21 stops, in order to prevent deformation, the first motor M1 for the fixing device is activated to rotate forcibly the fixing belt 21. With this configuration, heat of the fixing belt 21 is released. For example, as illustrated in FIG. 2, by rotating the fixing belt 21 forward by an amount expressed by L1−L2 (=L), where L1 is an entire length of the fixing belt 21 in the circumferential direction thereof and L2 is a length of the heated area of the fixing belt in the circumferential direction, the entire circumference of the fixing belt 21 receives residual heat of the halogen heater 23, making the entire belt to expand thermally and hence preventing deformation, i.e., an inward depression.

Figure 10:
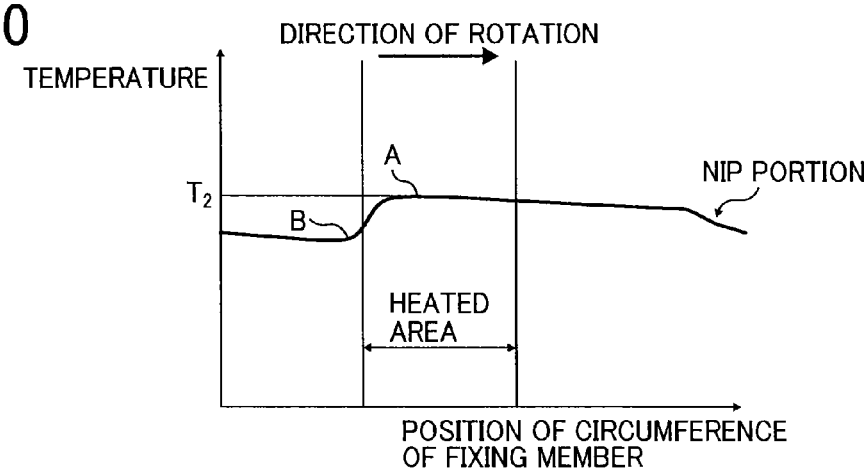
FIG. 10 is a graph showing a temperature distribution of the fixing belt in the circumferential direction thereof in a case in which the fixing belt is forced to rotate by an amount L1–L2 when the image forming apparatus stops abruptly and rotation of the fixing belt is halted.

FIG. 10 shows a temperature distribution of the fixing belt 21 in the circumferential direction thereof in the above case. According to the present illustrative embodiment, it is known that if the temperature difference between the temperature at the position A and the temperature at the position B is in a range of from approximately 90° C. to approximately 110° C., deformation (kink) can be prevented by rotating the fixing belt 21 by the amount L1−L2 (=L).

It is to be noted that the amount of rotation L is applied to a fixing belt which is made of a thin and elastic endless belt. In the case of a fixing belt having a configuration other than above, the amount of rotation can be less than or equal to L. Furthermore, the length L2 is defined by relative positions between the heater 23, the reflective plate 26, and the fixing belt 21.

In a case in which there is no recording medium P between the first sheet detector 40 disposed upstream from the fixing nip and the second sheet detector 41 disposed downstream from the fixing nip when the image forming apparatus 1 stops suddenly, the amount of rotation of the fixing belt 21 can be set without a limit, thereby allowing the entire circumference of the fixing belt 21 to uniformly absorb the residual heat of the halogen heater 23.

According to the present illustrative embodiment, the fixing belt 21 is rotated forward because forward rotation is more stable. As long as the fixing belt can make stable reverse rotations, the fixing belt can be rotated in the reverse direction.

In a case in which there is a recording medium P between the first sheet detector 40 disposed upstream from the fixing nip and the second sheet detector 41 disposed downstream from the fixing nip when the image forming apparatus 1 stops suddenly, if the fixing belt 21 is rotated forward, the recording medium P may be wound around the fixing belt 21, and as a result, users cannot remove jammed paper. Thus, when there is a recording medium P between the first sheet detector 40 and the second sheet detector 41, the fixing belt 21 shall be rotated reversely.

Figure 11:
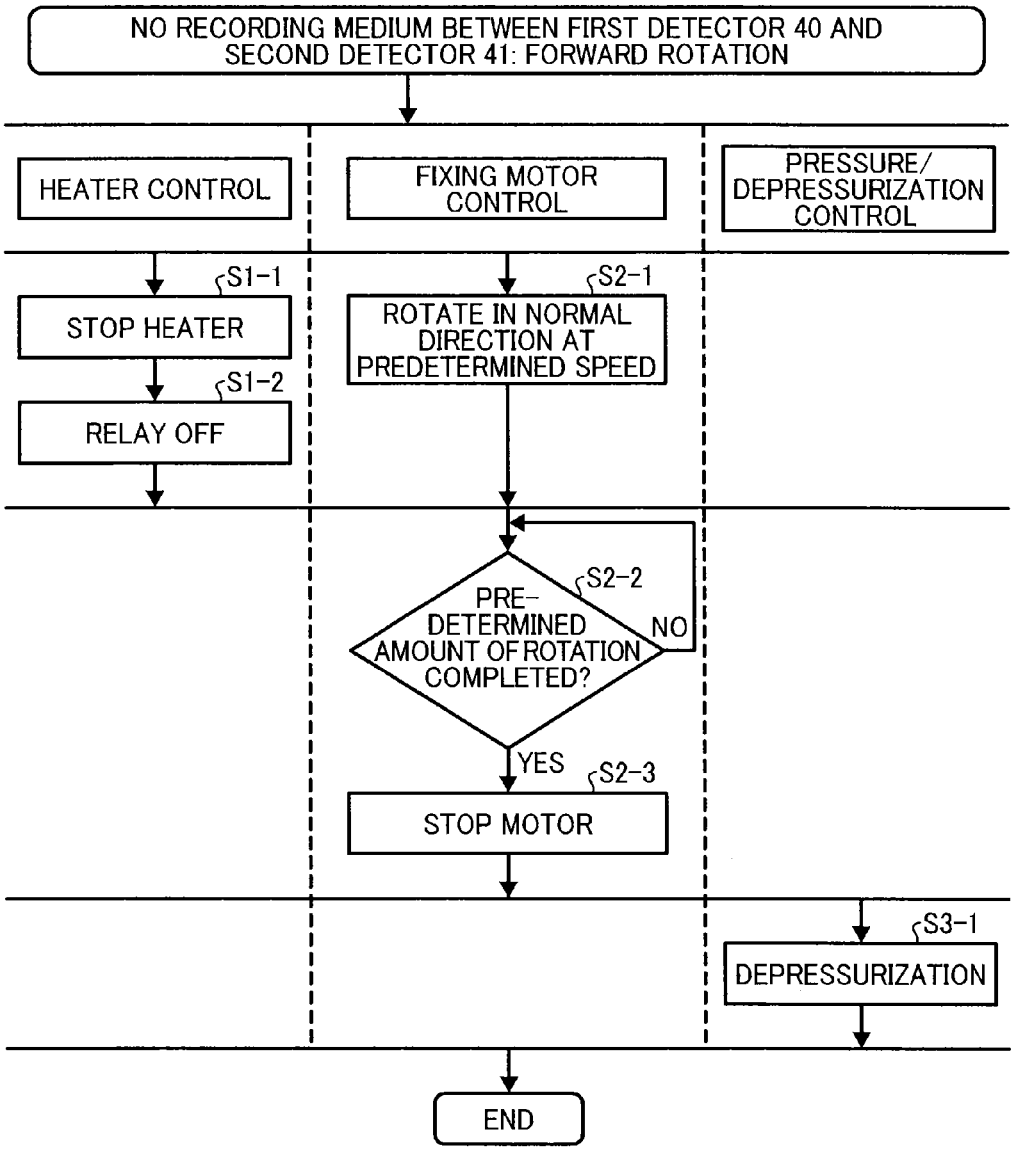
FIG. 11 is a flowchart showing steps in a process of preventing deformation of the fixing belt when rotating forward.

With reference to FIG. 11, a description is provided of steps in a process of preventing deformation of the fixing belt 21 when there is no recording medium P between the first sheet detector 40 and the second sheet detector 41, and the fixing belt 21 is rotated forward.

After detection of paper jams, the heater 23 is turned off at step S1-1 and the relay is turned off at step S1-2 in the heater control process. In the meantime, in the fixing motor control, the motor speed is changed to a forward-rotation linear velocity, thereby rotating the fixing belt 21 forward at step S2-1. After the fixing belt 21 makes a predetermined amount of forward rotation (YES at step S2-2), the motor is stopped at step S2-3. After the motor is stopped, the pressing roller 22 is separated from the fixing belt 21 at step S3-1 (depressurization), thereby completing the deformation prevention process.

Figure 12:
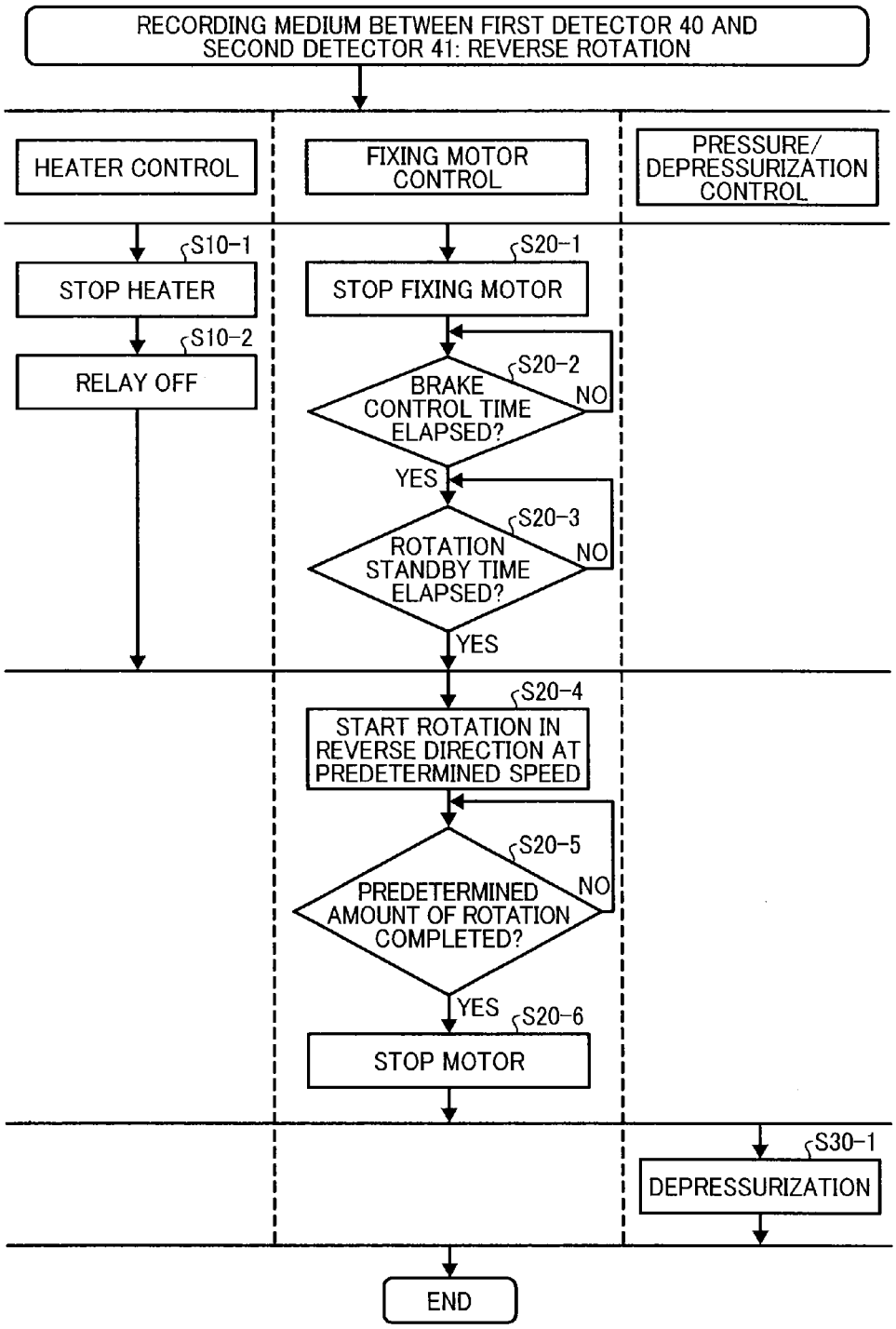
FIG. 12 is a flowchart showing steps in a process of preventing deformation of the fixing belt when rotating in an opposite direction.

With reference to FIG. 12, a description is provided of steps in the process of preventing deformation of the fixing belt 21 when there is a recording medium P between the first sheet detector 40 and the second sheet detector 41, and the fixing belt 21 is rotated reversely.

After detection of paper jams, the heater 23 is turned off at step S10-1 and the relay is turned off at step S10-2 in the heater control process. In the meantime, in the fixing motor control, the motor for the fixing device 20 is stopped at step S20-1. Subsequently, whether a brake control time (a guaranteed time of, for example, some tens of milliseconds required for the motor to make a complete stop) has elapsed is verified at step S20-2 so as to make sure that the fixing motor is stopped completely. After the brake control time elapsed (YES at step S20-2), whether a rotation standby time (which is a margin of time to ensure that the forward rotation of the fixing belt is switched to the reverse rotation) has elapsed is verified at step S20-3. After the rotation standby time elapsed (YES at step S20-3), a reverse rotation of the fixing belt 21 is started at step S20-4. After the fixing belt 21 makes a predetermined amount of reverse rotation (YES at step S20-5), the motor is stopped at step S20-6. After the motor is stopped, the pressing roller 22 is separated from the fixing belt 21 at step S30-1 (depressurization), thereby completing the deformation prevention process.

According to the present illustrative embodiment, the amount of reverse rotation is set within a range in which no deformation (kink) is generated and jammed paper does not damage the image forming apparatus 1. This is because, with a relatively large amount of reverse rotation, the jammed recording medium P may come into contact with the intermediate transfer belt 30 and damage the belt or the jammed recording medium P may enter small spaces inside the image forming apparatus 1. By contrast, with a relatively small amount of reverse rotation, deformation (kink) is difficult to occur. In order to prevent a failure such as deformation caused by the large number of reverse rotation, the maximum number of reverse rotation or the maximum distance of reverse rotation is configured within a distance from the trailing edge of the jammed recording medium P to the secondary transfer nip. The maximum number of the reverse rotation can be calculated in accordance with the length of the recording medium P in the sheet transport direction.

In order to prevent the deformation or the kink, a slow rotation time of the fixing belt 21 is effective. Thus, with a slow linear velocity, rotation time can be extended. In view of the above, the linear velocities of the forward and the reverse rotation are set equal to or less than the rotation speed employed before the fixing device 20 stops suddenly.

When the image forming apparatus stops abruptly and there is a recording medium P with relatively strong resilience between the first sheet detector 40 and the second sheet detector 41, if the fixing belt 21 is rotated reversely, the recording medium P may stick into and damage parts such as the intermediate transfer belt 30 and the secondary transfer roller 36 disposed upstream from the fixing device 20 in the sheet transport direction.

In view of the above, an amount of reverse rotation of the fixing belt 21 which does not cause the recording medium P to damage the upstream parts is calculated based on the length of the recording medium P in the longitudinal direction thereof (in the sheet transport direction). Accordingly, the fixing belt 21 is rotated reversely by the obtained amount, thereby moving the recording medium P for a proper distance. With this configuration, the parts disposed upstream from the fixing device 20 in the sheet transport direction are prevented from getting damaged by the recording medium P while preventing deformation (kink) of the fixing belt 21.

The above descriptions pertain to prevention of deformation or a kink caused by residual heat of the heat source. In addition, residual heat from the reflector, the stay, the heated internal air may also cause the temperature of the heated area of the fixing belt to rise when the fixing belt is stopped, causing the deformation of the fixing belt. In view of the above, the heated area of the fixing belt when rotation of the fixing belt is stopped is moved to the fixing nip portion so that the pressing roller and so forth can take away the heat. At least the leading edge of the heated area or the place closest to the heat source is moved to the fixing nip portion.

The present invention can be applied to a belt-type fixing device having a configuration in which the fixing belt is entrained about a fixing roller and a heating roller, and the heating roller is pressed against the fixing roller via the fixing belt. Alternatively, the present invention can be applied to any other types of the fixing device. In a case in which the fixing belt is entrained about the fixing roller and the heating roller, the heating roller may be driven by a motor. Moreover, the fixing device according to the present invention is not restrictively mounted in the color laser printer illustrated in FIG. 1, but can also be mounted in a monochrome image forming apparatus.

According to an aspect of this disclosure, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A fixing device comprising:

a heat source;

a fixing member looped into a generally cylindrical shape to rotate in a circumferential direction thereof and is at least partially heated by the heat source, the fixing member heating a surface of a recording medium bearing an unfixed toner image to fix the unfixed toner image thereon in a fixing process;

a rotary pressing member disposed facing the fixing member to form a nip therebetween, through which the recording medium is transported in a transport direction; and a rotation driver to rotate one of the fixing member and the pressing member, wherein in a case in which the fixing member is halted for a reason other than the fixing process while power of the fixing device is on, electric power is not supplied to the heat source and the fixing member is rotated by a predetermined amount or more after the fixing member is halted.

2. The fixing device according to claim 1, wherein the predetermined amount of rotation is an amount necessary for moving a portion of the fixing member closest to the heat source at the time of halting the fixing member to the nip.

3. The fixing device according to claim 1, wherein the predetermined amount of rotation satisfies the following relation: $L_1$-$L_2$, where $L_1$ is a circumferential length of the fixing member and $L_2$ is an area of the fixing member heated by the heat source.

4. The fixing device according to claim 1, further comprising:

a first sheet detector to detect the recording medium, disposed upstream from the nip in a sheet transport path along which the recording medium is transported in the transport direction; and a second sheet detector to detect the recording medium, disposed downstream from the nip in the sheet transport path, wherein in a case in which the recording medium is not between the first sheet detector and the second sheet detector at the time of halting the fixing member, the fixing member is rotated forward.

5. The fixing device according to claim 1, further comprising:

a first sheet detector to detect the recording medium, disposed upstream from the nip in a sheet transport path along which the recording medium is transported in the transport direction; and a second sheet detector to detect the recording medium, disposed downstream from the nip in the sheet transport path, wherein in a case in which the recording medium is between the first sheet detector and the second sheet detector at the time of halting the fixing member, the fixing member is rotated reversely.

6. The fixing device according to claim 5, further comprising a storage device to store a length of the recording medium in the transport direction of the recording medium, wherein an amount of reverse rotation of the fixing member is changed in accordance with the length of the recording medium stored in the storage device.

7. The fixing device according to claim 5, wherein in accordance with the length of the recording medium in the transport direction, a maximum amount of reverse rotation is determined.

8. The fixing device according to claim 1, wherein in a case in which the fixing member is rotated by the predetermined amount after rotation of the fixing member is halted, a rotation speed of the fixing member is equal to or less than the rotation speed before rotation of the fixing member is halted.

9. The fixing device according to claim 1, further comprising a temperature detector to detect a temperature of the fixing member, wherein after rotation of the fixing member is halted upon completion of the fixing process and the temperature detector detects that the temperature of the fixing member reached a predetermined temperature, the fixing member is rotated.

10. An image forming apparatus comprising the fixing device according to claim 1.

11. The fixing device according to claim 1, further comprising a sheet output roller, wherein a first motor drives the fixing member and a second motor drives the sheet output roller.

12. The image forming apparatus according to claim 10, further comprising sheet output rollers that are downstream from the fixing device.

13. The image forming apparatus according to claim 12, wherein a first motor drives the fixing member and a second motor drives the sheet output rollers, and wherein, the first and second motors are independent motors.

14. The image forming apparatus according to claim 12, wherein a first motor drives the fixing member and a second motor drives the sheet output rollers, and wherein, the first and second motors are the same motor.

15. The fixing device according to claim 1, wherein the fixing member is a belt and has a thickness equal to or less than 0.4 mm.

16. The fixing device according to claim 1, wherein the fixing member is a belt and has a thickness equal to or less than 0.2 mm.

17. The fixing device according to claim 1, wherein the fixing member has a diameter in a range of 20 mm to 40 mm.

18. The fixing device according to claim 1, wherein the fixing member has a diameter equal to or less than 30 mm.

19. The fixing device according to claim 1, wherein the fixing member is a belt and includes at least a base member, an elastic layer, and a separating layer.

20. The fixing device according to claim 5, wherein the fixing member has a thickness equal to or less than 0.4 mm.

21. The fixing device according to claim 5, wherein the fixing member has a thickness equal to or less than 0.2 mm.

22. The fixing device according to claim 1, wherein the fixing member is a belt and includes a nip forming member and a stay inside the fixing member, and the nip forming member is supported by the stay.

* * * * *

UNITED STATES PATENT AND TRADEMARK OFFICE

CERTIFICATE OF CORRECTION

PATENT NO. : 9,239,559 B2
APPLICATION NO. : 13/763040
DATED : January 19, 2016
INVENTOR(S) : Takeshi Uchitani et al.

It is certified that error appears in the above-identified patent and that said Letters Patent is hereby corrected as shown below:

On the title page, Item (30), the Foreign Application Priority Data is incorrect. Item (30) should read:

-- (30) Foreign Application Priority Data

Feb. 9, 2012 (JP) ..... 2012-026059
Dec. 21, 2012 (JP) ..... 2012-279346 --

Signed and Sealed this
Third Day of May, 2016

Michelle K. Lee

Michelle K. Lee
*Director of the United States Patent and Trademark Office*